US012060703B2

(12) United States Patent
Ramirez Navarro

(10) Patent No.: US 12,060,703 B2
(45) Date of Patent: Aug. 13, 2024

(54) TOILET-TYPE DEVICE

(71) Applicant: Arturo Ramirez Navarro, Santiago (CL)

(72) Inventor: Arturo Ramirez Navarro, Santiago (CL)

( * ) Notice: Subject to any disclaimer, the term of this patent is extended or adjusted under 35 U.S.C. 154(b) by 20 days.

(21) Appl. No.: 17/918,983

(22) PCT Filed: Jun. 22, 2021

(86) PCT No.: PCT/CL2021/050053
§ 371 (c)(1),
(2) Date: Oct. 14, 2022

(87) PCT Pub. No.: WO2021/237374
PCT Pub. Date: Dec. 2, 2021

(65) Prior Publication Data
US 2023/0313517 A1 Oct. 5, 2023

(51) Int. Cl.
*E03D 11/02* (2006.01)

(52) U.S. Cl.
CPC ..... *E03D 11/025* (2013.01)

(58) Field of Classification Search
CPC ..... E03D 11/025
USPC ..... 4/342
See application file for complete search history.

(56) References Cited

U.S. PATENT DOCUMENTS

| | | | | |
|---|---|---|---|---|
| 1,505,048 | A * | 8/1924 | McLeod | E03D 9/08 137/561 R |
| 8,032,955 | B1 * | 10/2011 | Emerson | A47K 13/24 4/341 |
| 2018/0135284 | A1 | 5/2018 | Hurtado Torres | |
| 2020/0015636 | A1 * | 1/2020 | Warren | E03D 5/016 |

FOREIGN PATENT DOCUMENTS

| | | | |
|---|---|---|---|
| CN | 101824851 | A | 9/2010 |
| CN | 208363216 | U | 1/2019 |
| KR | 20050116326 | U | 5/2011 |
| KR | 101492182 | B1 | 2/2015 |

OTHER PUBLICATIONS

International Search Report, INAPI, Chilean Patent Office, dated Sep. 9, 2021.

* cited by examiner

*Primary Examiner* — Huyen D Le
(74) *Attorney, Agent, or Firm* — Bay State IP, LLC

(57) ABSTRACT

Toilet like device, which saves water through the separation of solid and liquid depositions, in a hygienic, comfortable, simple, autonomous and aesthetic manner. It's composed by a main toilet body, which has an open space within itself, connected to the main toilet bowl, a space which is open in its front and superior sides. This space works as a water and urine recipient, the water and urine come from the urinal, which at the same time works as a drainage for urine and water. This space also works as a liquid recipient when the urinal is in vertical position, since it is very likely that, after a liquid deposition, the urinal needs to be raised towards a vertical position, for various different reasons. Any liquid remaining in the urinal falls into this space, without going into the rest toilet body, and much less onto the user.

6 Claims, 7 Drawing Sheets

TOILET-TYPE DEVICE

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/CL2021/050053 filed on Jun. 22, 2021, and which in turn claims priority under 35 USC 119 to Chilean Patent Application No. 1410-2020 filed on May 27, 2020.

This application is in regards to a toilet device, related to the sanitary area.

More specifically, it regards a device, characterized by achieving a water saving function, through the separation of liquid and solid discharges, in a manner which is hygienic, comfortable, simple and self-sufficient.

CURRENT STATE OF THE ART

Currently, because of climate change and its consequences, there are serious problems relating to water consumption and scarcity. This has driven several cities and countries to take the necessary measures to look after water consumption, along with individuals to come up with ways of saving water.

In the sanitary area, several water saving devices have been created, such as urinals, which have been very helpful when it comes to saving water, because the regular person urinates 6-7 times in 24 hours. This means that a single person could save approximately 5 400 gallons of water a year, by just using a urinary, however, there have been several problems for its mainstream use.

The main technical difficulties are:

- It would be very expensive and problematic to install in the common household, since not all of them have the space or conditions required for the installing of urinals.
- Mostly, urinals are for men, and women's urinals are much larger, which would make the installation even more complicated, especially if somebody wanted to install both systems (feminine and masculine), this means that most homes remain using the traditional toilet as their sanitary system.
- Water saving toilets, such as that very famous one, which include a double discharge tank for solid (approximately 2 gallons) and liquid depositions (approximately 1 gallon) still generate big water spences when it comes to liquid depositions, because they discharge half of the tank contents to remove the water caught between the bottom and the siphon.
- Regarding other toilets, such as the NoMix toilet, designed to separate liquid and solid discharges, which became popular in Europe, 80-85% of people saw it as a good idea. After some time of usage, people became more critical towards this technology, basically due to the fact man had to sit down to urinate, and women had to aim precisely, these where the conclusions of a 6-year study by the Swiss Federal Institute of Aquatic Science and Technology. The company which produced the NoMix toilets stopped manufacturing them.

Regarding the present invention, there are documents similar to it, they are as it follows:

Nos. US2018135284 (A1) y KR101492182 (B1), however, there are details which vary against the characteristics of this invention, to be exposed hereafter:

U52018135284 (A1)

- There is no mention of a toilet tank with a short water discharge system, independent from the solid depositions discharge, needed by the urinal; it just generally mentions various pipes connected to the tank. It also does not describe in which way, or through what mechanism do the discharge pipes are connected to the urinal for its cleaning. What's more, it describes that cleaning the urinal is not necessary, which is not hygienic.
- The urinal for the US2018135284 (A1) patent spreads from the back of the tank towards the front, and its altitude goes from the base of the toilet to the top of it, not considering the existing water at the bottom of the tank. This means the existing water is at the urinal's level, and when it opens, closes, or remains static in any position, water will leak from the water tank towards the posterior chamber, or towards the outside, which would become a constant water leakage problem, since there is no description of a closing mechanism between the urinal and the toilet bowl.
- The US2018135284 (A1) is unrealistic regarding its dimensions, the length for the urinal of the present application would be notoriously inferior.
- FIGS. 8, 9 & 10 display how the urinal covers the toilet almost completely, but in FIGS. 1, 2 & 3, it changes, because in FIG. 3, the length of the urinal grows, and the length of the body of the toilet diminishes when compared to FIGS. 1 & 2 (it is measurable). This means that, if you really what to cover a big part of the toilet's length, the span or the urinal would surpass the altitude of the superior part, which would make it very uncomfortable for solid depositions, and, if the length were to be realistic, it would cover half the length of the toilet, which would make It not as comfortable for male liquid depositions, or they would have to urinate sitting down, just like in the NoMix toilet.
- In FIG. 8, when the urinal is in vertical position, the curvature of the urinal adapts to the curvature of the bowl, but in FIG. 10, the curvature is inverted, and it adapts for the front part of the toilet, how this would be possible remains unexplained, this means that, if the curvature is like in FIG. 8, if the urinal is positioned for liquid depositions, urine would end up in the toilet bowl and not in the urinal. And, in the case the curvature was inverted, like in FIG. 10, when in vertical position, it would stand out from the bowl's curvature, which would make it very likely for solid depositions to fall on top of the urinal, which would not be comfortable or hygienic, and would have to be cleaned manually.
- It also remains unexplained how it is possible that the superior side of the urinal, in FIG. 10, grows in size when compared to FIG. 8. This means that, if we consider the width of the urinal in FIG. 8, the urinal would be very thin and would cover only the center part of the bowl, which is uncomfortable for liquid depositions.
- It is also not described in which way or mechanism the urinal works for the closing and opening. This is important, because this kind of mechanism generally raises the factory costs.

KR101492182 (B1)

- The duct for urine discharge (60), leading to the sewer system, is independent from the solid depositions duct (14), which also leads to the sewer system. This makes it difficult to replace a traditional toilet for the proposal of the mentioned patent, since most homes only have one duct for the sewer system.

When the urinal (30) is in vertical position, (for solid depositions) the corrugated pipe (40) is in an oval position starting from the toilet bowl, then it passes the solid deposition seat (20), and it ends in the urinal (30). The main problem with this system, is that it is uncomfortable for the person in the position for solid discharges, because the corrugated pipe touches the person in this position. This is also unhygienic, because it is very likely for the pipe to get stained with excrement because of solid depositions, and there is no mention of a self-cleaning mechanism after solid depositions. Another problem is that when moving the urinal to a vertical position, it is very likely for the corrugated pipe gets hooked on the solid depositions seat (20), this can move the tube from its position, or produce premature erosion towards it. Last but not least, it looks bad aesthetically.

The tank doesn't have a short water discharge system for the urinal (30), independent from the solid deposit discharge. There is no water tube connection between the urinal and the toilet tank.

The clean water, inserted in the tubing (32) of the urinal, mentions that it needs to be reloaded in an external manner, and it doesn't mention where the water comes from, which would make it seem that it needs to be loaded manually. This would be uncomfortable for the user, because the tube system needs to be loaded manually each time a liquid deposition happens.

There is no mention of a toilet seat for women's solid deposition on the urinal's bowl, this is unhygienic and uncomfortable for women, because when men urinate, they involuntarily stain the outline of the toilet bowl.

Although the previously mentioned methods claim to accomplish the saving function throughout the separation of solid & liquid depositions, it doesn't manage it in a manner which is hygienic, comfortable simple, nor aesthetically pleasing, which should be the characteristic of a urinary system.

The solution proposed in this application, has the objective of creating a toilet with the capability to save water, throughout the separation of liquid and solid deposition in a manner which is hygienic, comfortable, simple, autonomous and aesthetically pleasing.

The device in the present application, basically consists on a main toilet, in which the edge of the bowl is designed for non-liquid, solid depositions, just like in traditional toilets, and, at the same time this main toilet possesses a covered space in the posterior side of the toilet bowl which functions as the recipient of urine and water, and is connected to the drainage. Then, there is the urinal the seat for women, and the double discharge tank.

The advantage of this toilet lies in the fact that the recipient for urine and water is integrated into the body of the toilet, and since it is open in the back and above areas, allows for perpendicular movement of the urinal with no obstacles.

Other advantage for this recipient is that, since it is opened in the above area, it allows any liquids remaining on the urinal, in a vertical position, to fall into the recipient without falling into another area of the toilet.

Another advantage is that this urinal can be cleaned with water, already available in the toilet tank rather than externally, all of it without any complex system added to the toilet, such as tubes, for example, that can be uncomfortable, unhygienic and bad looking.

These advantages manage to work correctly thanks to the design of the main body of the toilet, since it is designed, from the beginning, for solid rather than liquid depositions, just like a traditional toilet. This is fundamental, because it allows for the correct functioning of the other elements and doesn't allow for extra pieces or stages.

These advantages allow that the toilet proposed in this application is capable of saving water, through the separation of liquid and solid deposits, and for it to be hygienic, comfortable, simple, autonomous and aesthetically pleasing.

DETAILED DESCRIPTION OF INVENTION

Figure 1:
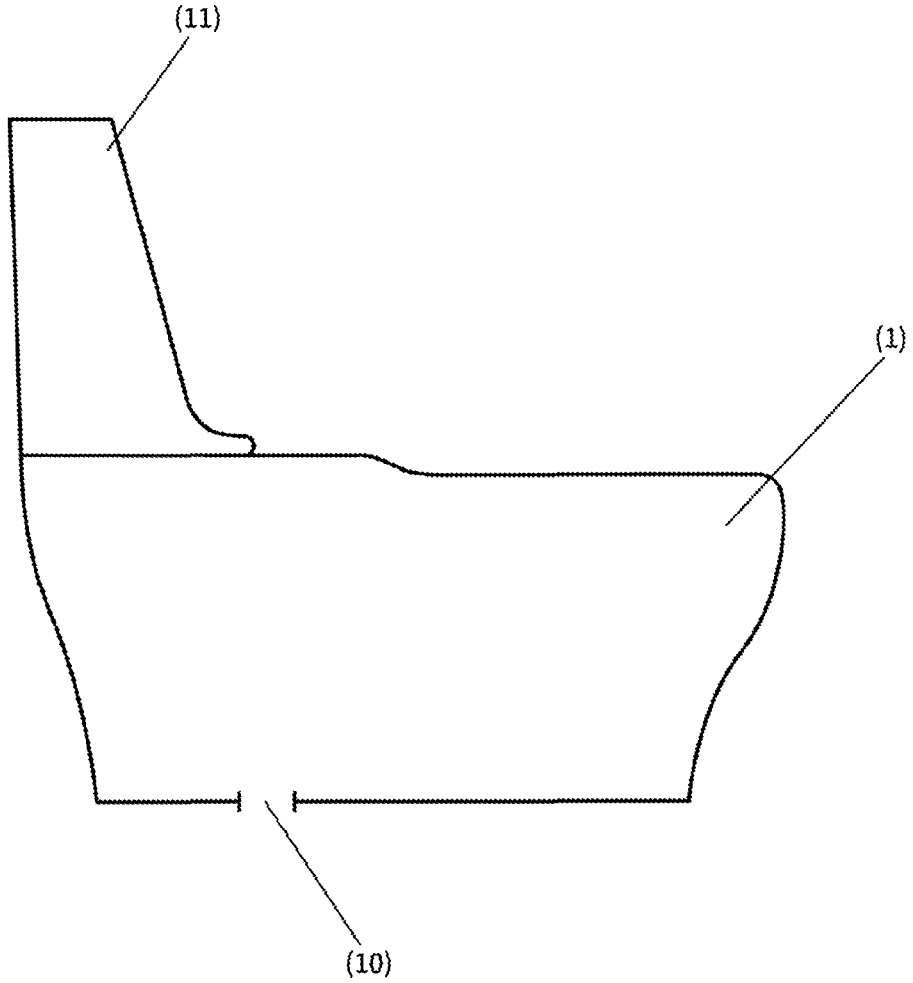
FIG. 1: Displays a side view of the body of the toilet, designed for solid depositions.
Figure 2:
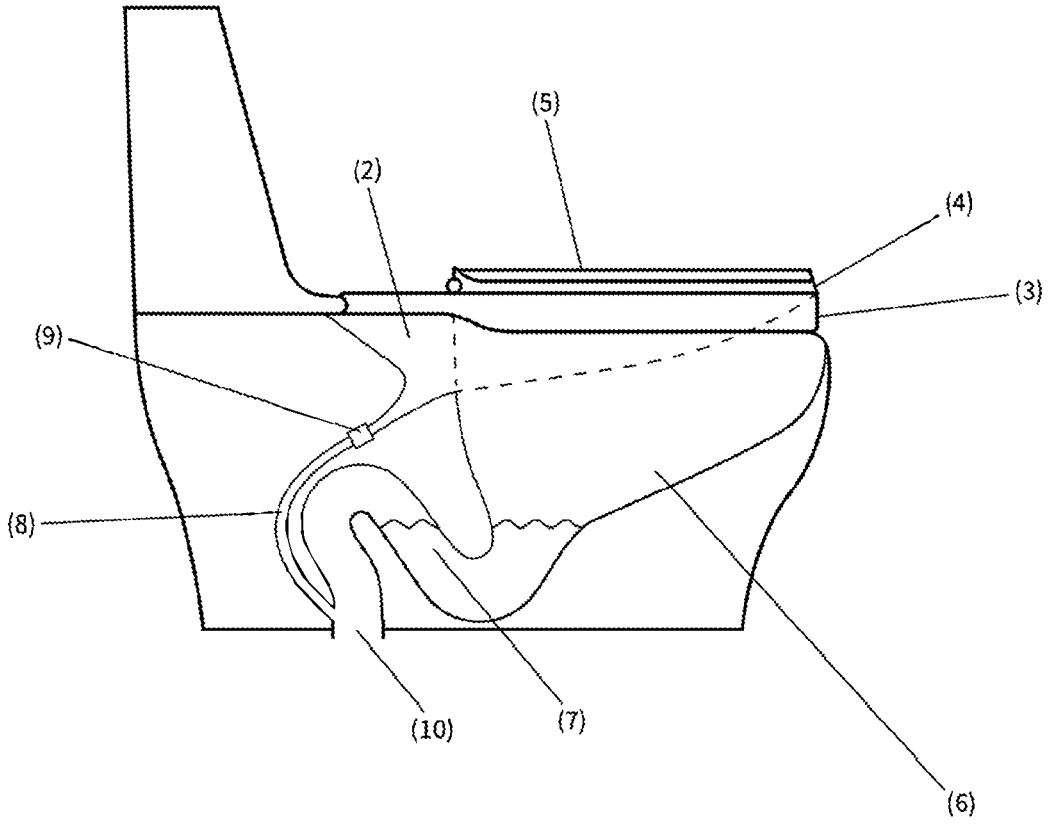
FIG. 2: Displays a lateral, interior view of the toilet, showing the recipient for urine and water, the toilet bowl, the urinal, the urinal seat for women and the lid.
Figure 3:
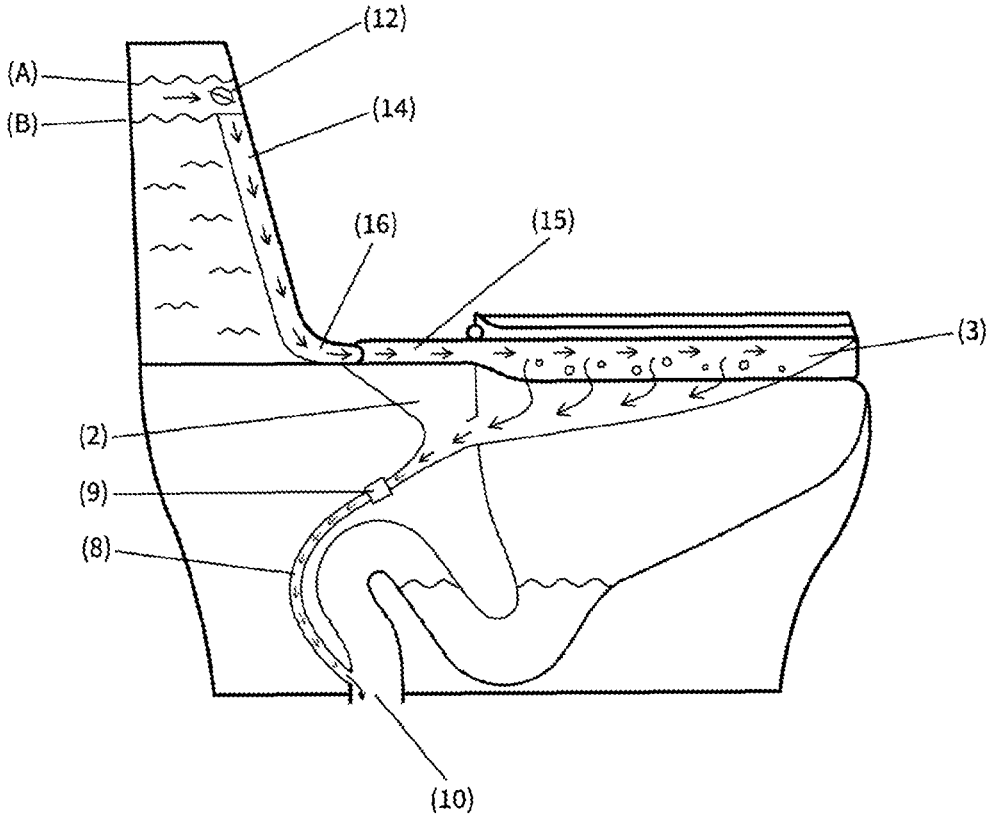
FIG. 3: Displays a lateral, interior view of the toilet, showing the short discharge, which goes from the tank, through the urial, the water and urine recipient, and draining tube, to the sewers. It also shows two levels of water in the tank (A & B) in which "A" shows the level of water before short discharge of water for the urinal, and where "B" shows the level of water after the short discharge.
Figure 4:
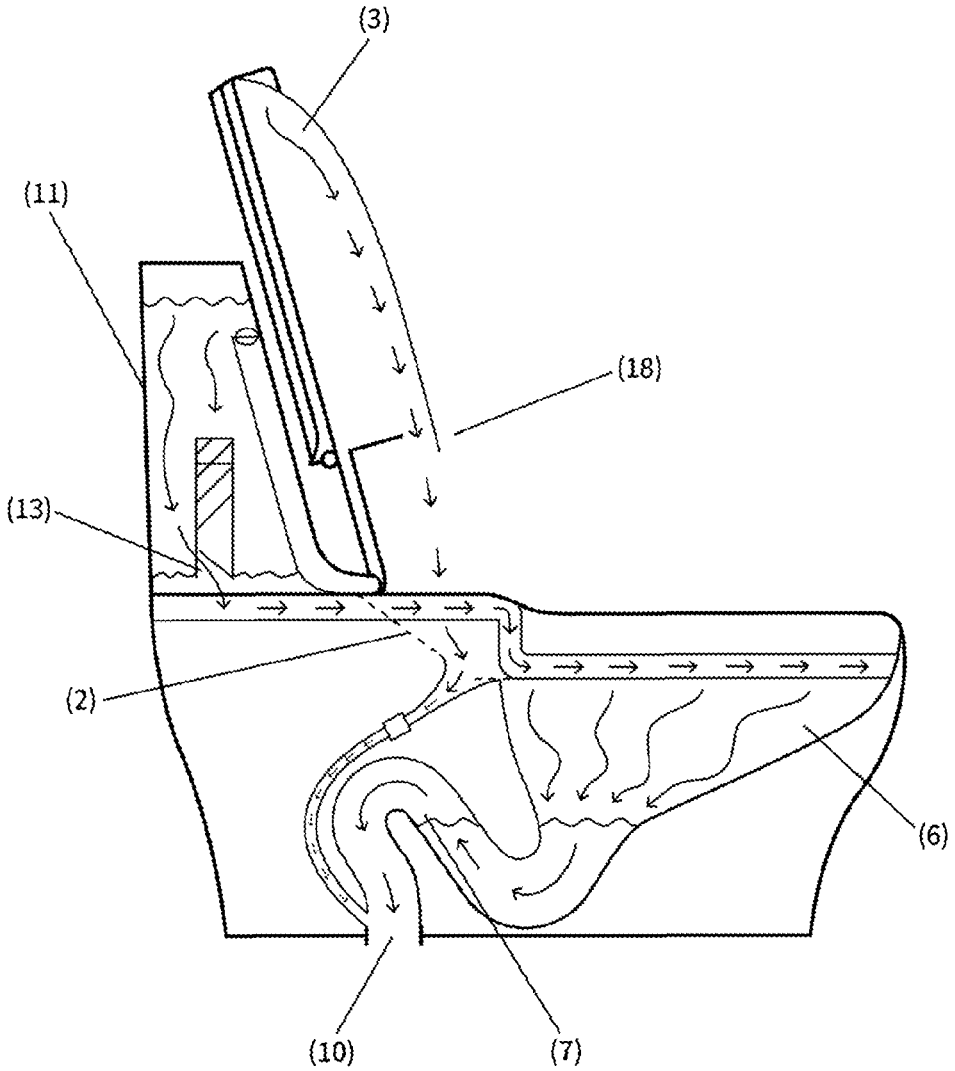
FIG. 4: Displays a lateral, interior view of the toilet, showing the water discharge for solid depositions, which goes from the tank, through the tank and siphon, to the drainage. It also shows the urinal in vertical position, where it shows how the remains of water and urine fall into the recipient for water and urine, not falling into any other place.
Figure 5:
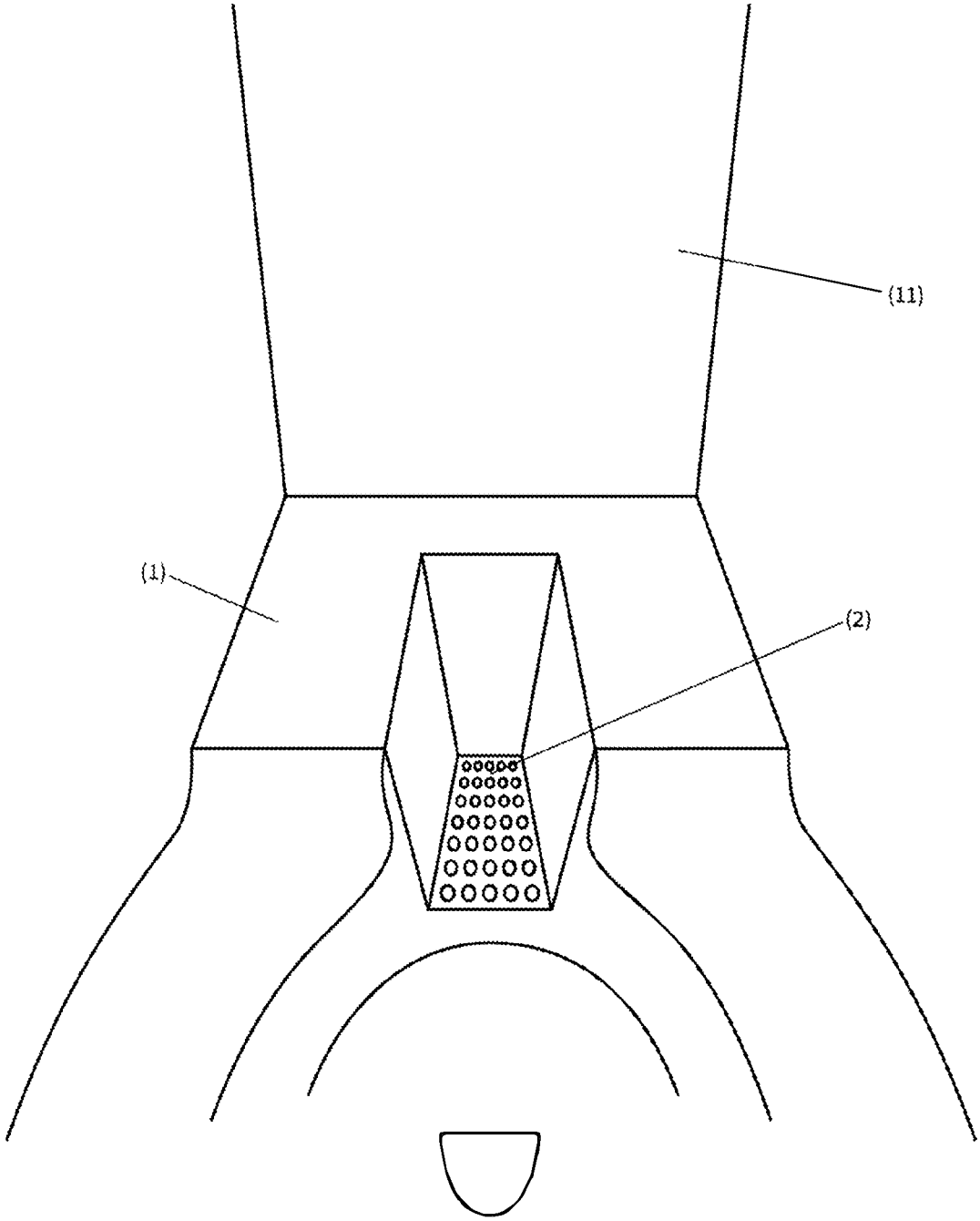
FIG. 5: Displays a frontal view of the main body of the toilet, where it shows the design for solid depositions and the water and urine recipient.
Figure 6:
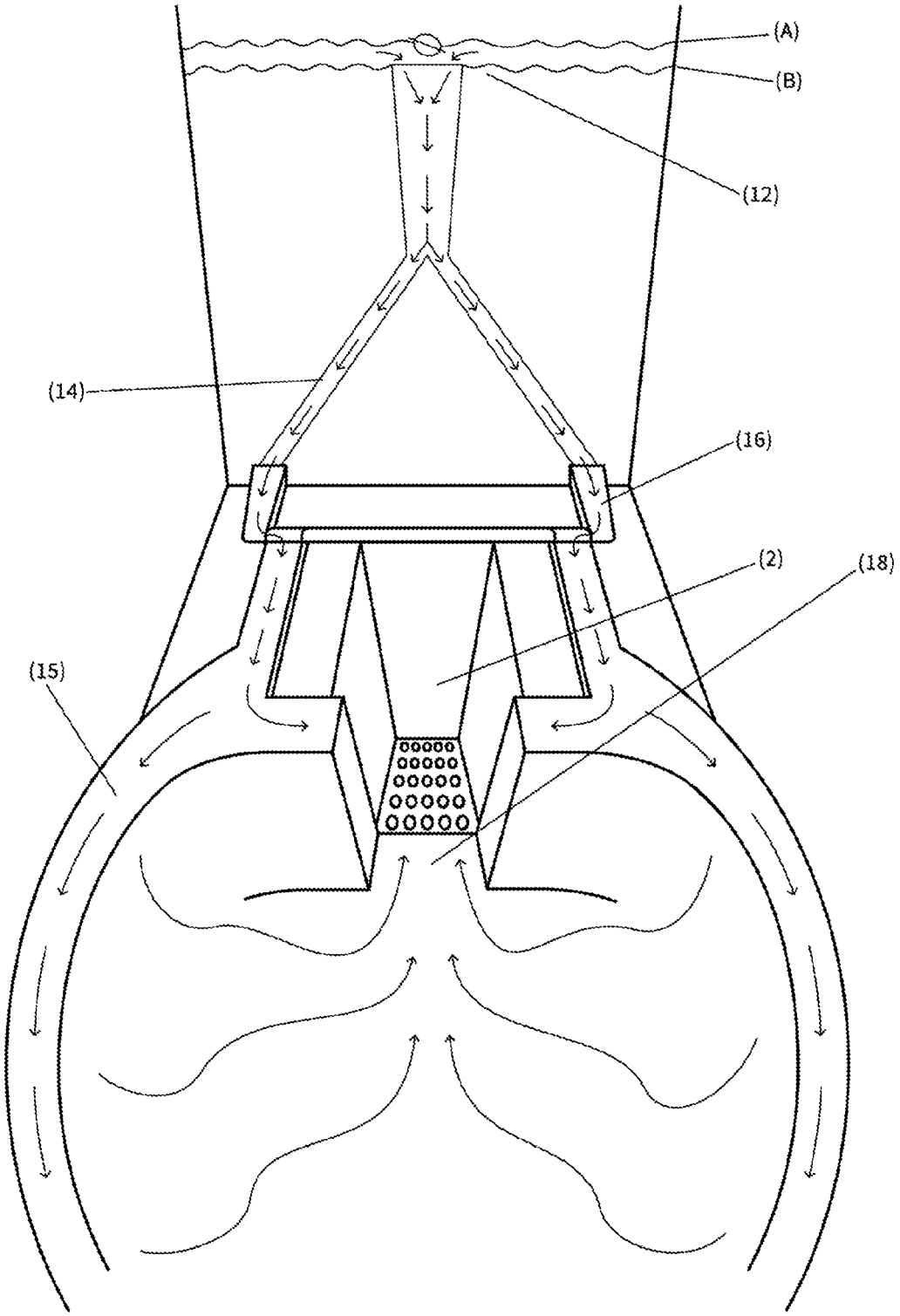
FIG. 6: Displays a frontal view of the urinal above the body of the toilet in a vertical position, which shows that the urinal fits the main body of the toilet ant to its water and urine recipient. It also shows the water flow of the short discharge, which goes from the superior discharge valve, through the front exits of the tank water, continues through the edges of the urinal and ends in the urine and water recipient. It also shows two levels of water in the tank (A & B), where "A" shows the level of water prior to the short water discharge for the urinal, and where "B" shows the level of water after the short discharge.
Figure 7:
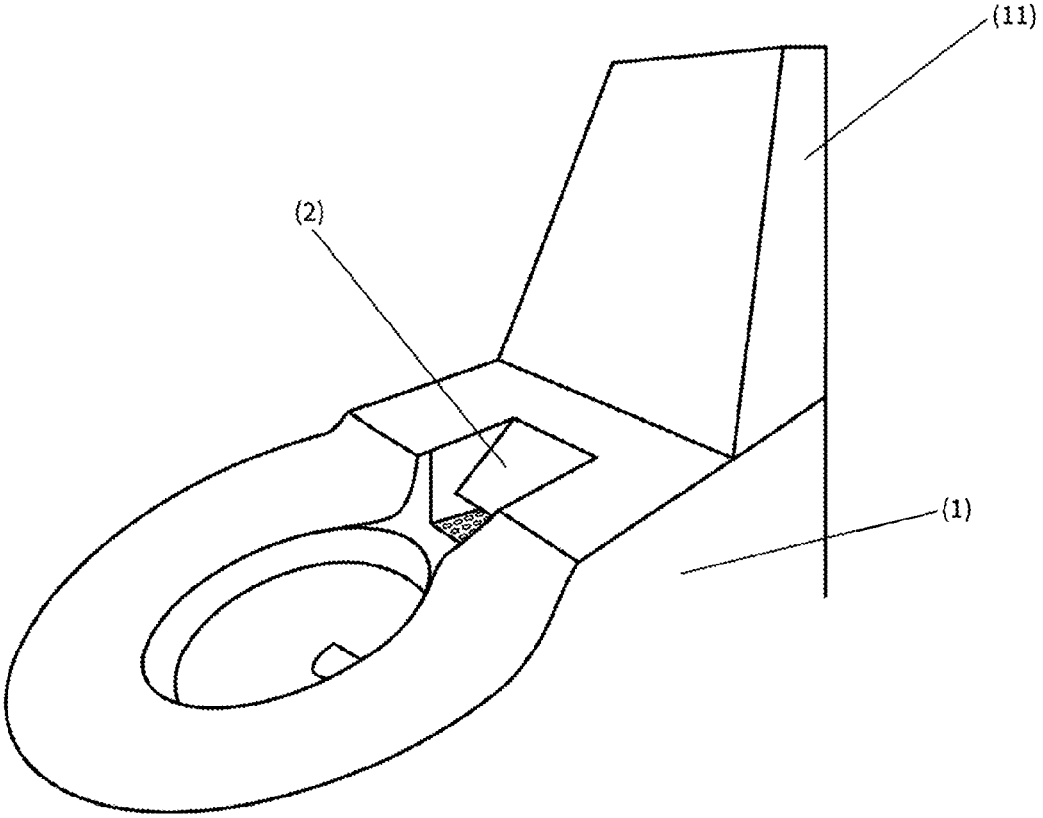
FIG. 7: Displays a semi-frontal view of the toilet body, showing the water and urine recipient in a more aesthetic manner, because it has a diagonal lid, which covers approximately ¾ of the recipient, to visually cover the holes of the urine and water recipient when the toilet is unused; and diagonal, so, when it is in a vertical position, the diagonal can direct de liquid drops which fall into it towards the center of the recipient and drainage, unlike FIGS. 5 & 6, which display the water and urine recipient in a more rustic manner, for a better visual understanding of the recipient.

The toilet of the present application basically consists of a main body of toilet (1) in which the edge of the bowl is designed for the non-liquid, solid depositions, like in traditional toilets.

This makes it so the order in which the bowls, seats and lid are put changes, when compared to traditional toilets.

That is fundamental so the system works, and there are no excess pieces or stages, because, if the main body of the toilet (1) was meant for liquid deposition, logically, the seat for solid depositions would have to be above the body of the toilet, which would make the installment of the urinal (3) above the seat, difficult. And it would make no sense to have two different positions or stages to urinate.

In the same main body (1), at the posterior side of the bowl (6), there is a little open space connecting to the main bowl (6) of the toilet, in which the superior edge is at the same height of the superior edge of the main bowl (6). This space functions as a water and urine recipient (2), The urine and water would come from the urinal (3) at the same time, working as a drainage for both water and urine, where the urine drainage tubes (8) has an anti-return valve (9) to avoid the smell coming from the sewer system. This same urine draining tube system (8) is connected directly to the drainage (10).

The water and urine recipient (2) functions as a liquid recipient when the urinal (3) is in a vertical position, because it is very likely that, after dropping liquid depositions, the urinary needs to be lifted towards a vertical position, for various reasons. The remaining liquids in the urinal (3) will fall in this space, without going into the rest of the toilet body (1), and much less on the user.

This is one of the reasons why the water and urine recipient (2) is an open space in its back and superior side.

The other reason is so the opening of the urinal (18) can move without obstacles when the urinal (3) makes the perpendicular move from a horizontal position toward a vertical one, and vice-versa. Upwards is the urinal (3), which goes over the superior edge of the bowl (6) of the toilet body (1). This urinal (3) perfectly fits the bowl (6) and the water and urine recipient (2). Then comes the toilet seat for women (4) which goes above the urinal (3) and, for hygienic reasons, avoids women from going into contact with the urinal (3), because men involuntarily stain the urinary (3) edge. Then the lid of the toilet (5), and lastly, the tank of the toilet (11), which has a double water discharge system. The solid depositions discharge releases the already available water from the tank (11) through an interior discharge valve (13), which goes directly to the toilet bowl (6), and in time, the same water goes through the siphon (7), to go to the drainage (10). The other discharge, which is a short water discharge for liquid depositions, works, because inside of the tank (11) there is a top discharge valve (12) which takes water from the superior side of the tank (11) which can be a small quantity, because it will take the water according to the water level, regulated inside the tank (11) with conventional systems. This water falls because of gravity into the top discharge tubes (14) which are inside the tank (11), which are divided in two at the center of the tank (11), to go out through the front exits (16) of it (11), In which the front exits (16) are connected to the urine discharge tubes (15), in order for a water discharge to clean the toilet (1).

Then, this same water goes through the water and urine recipient (2) to go straight to the drainage system (10) through the urine drainage tube (8).

The invention claimed is:

1. A toilet device, which saves water through the separation of solid and liquid depositions, in an hygienic, comfortable, simple, and autonomous manner comprising: a main toilet body (1), which in the same main body, there is an open space which connects to a main bowl (6) of the toilet (1), a space which is open in a front part and an above part, the space works as a water and urine recipient (2); then comes a urinal (3), which goes above a superior edge of the bowl (6) of the toilet (1) body, this urinal (3) has a perpendicular movement, which pivots from a posterior side, which is connected to the main body of the toilet (1), the urinal (3) perfectly fits the bowl (6) and the water and urine recipient (2), then comes a toilet seat for women (4), which goes above the urinal (3); then comes a toilet lid (5), and lastly, a toilet tank (11), which has a double discharge system, one of them going to the toilet bowl (6) for solid depositions, and the other foes directly to the urinal (3) for liquid depositions, the latter being of a short discharge, and functioning by a high-rise water inlet system.

2. The toilet device, according to claim 1, wherein said urinal (3) adapts to the toilet bowl (6) and the water and urine recipient (2).

3. The toilet device, according to claim 2, wherein the water and urine recipient (2), by being an open space on the superior side, allows for the decant of the liquids coming from the urinal (3) when it is in vertical position, without going into the rest of the toilet (1).

4. The toilet device, according to claim 1, wherein the water and urine recipient (2) being an open space in its superior and front sides, which allows for free movement of the urinal (3) from a horizontal to a vertical position and vice versa, specifically, so there are no obstructions in the toilets opening (18).

5. The toilet device, according to claim 1 wherein the women's toilet seat (4) adapts comfortably to the urinal.

6. The toilet device, according to claim 1, wherein the tank (11) has an altitude water hose through a valve (12), which works by decantation and allows a minimal water discharge, at the same time, said tank (11) connects to the urinal (3), through internal tubes, for water discharge and self-cleansing of the urinal (3).

* * * * *